US006036995A

United States Patent [19]

Kircher et al.

[11] Patent Number: 6,036,995

[45] Date of Patent: Mar. 14, 2000

[54] METHOD FOR REMOVAL OF SURFACE LAYERS OF METALLIC COATINGS

[75] Inventors: Thomas A. Kircher, Douglassville; Bruce G. McMordie, Perkasie; Mark F. Mosser, Perkiomenville, all of Pa.

[73] Assignee: Sermatech International, Inc., Limerick, Pa.

[21] Appl. No.: 08/797,691

[22] Filed: Jan. 31, 1997

[51] Int. Cl.[7] ..... B05D 1/32; B05D 3/02

[52] U.S. Cl. ..... 427/142; 427/264; 427/282; 427/287; 427/383.7

[58] Field of Search ..... 427/142, 261, 427/264, 282, 287, 383.7

[56] References Cited

U.S. PATENT DOCUMENTS

| | | | |
|---|---|---|---|
| 3,622,391 | 11/1971 | Baldi | 134/3 |
| 4,724,172 | 2/1988 | Mosser et al. | 427/383.5 |

FOREIGN PATENT DOCUMENTS

| | | |
|---|---|---|
| 0713957 | 5/1996 | European Pat. Off. . |
| WO 93/03201 | 2/1993 | WIPO . |

OTHER PUBLICATIONS

Viswanathan, R., and Allen, J.M., Proceedings of an International Conference by ASM International and the EPRI, "Life Assessment and Repair Technology For Combustion Turbine Hot Section Components" (1990), (no month date).

Czech, N., and Kempster, A., AK/S/Cannes/Iss8, "Reproducible Removal of Consumed MCrAlY Coatings from Industrial Gas Turbine Blades", (Apr. 23, 1996).

*Primary Examiner*—Katherine A. Bareford

*Attorney, Agent, or Firm*—Weiser and Associates, P.C.

[57] ABSTRACT

A method for removing surface layers of a metal coating is disclosed. The method comprises applying an aluminum containing slurry to the surface of the metal coating, melting and diffusing the aluminum to form an aluminide layer within the surface of the metal coating, and removing the aluminide layer.

29 Claims, 5 Drawing Sheets

METHOD FOR REMOVAL OF SURFACE LAYERS OF METALLIC COATINGS

FIELD OF THE INVENTION

The invention relates to the field of the removal of metallic coatings, such as iron, nickel, and/or cobalt based metallic coatings, which are used to provide enhanced surface properties, such as wear and corrosion resistance.

BACKGROUND

Metallic coatings, comprising alloys of iron, nickel, and/or cobalt, are used on a wide variety of industrial hardware in order to provide properties, such as wear resistance, abrasion resistance, corrosion resistance, and lubricity, which are lacking in the component substrate material of the hardware. The metallic coating layer may be formed by modifying the surface layer of a metallic substrate by a diffusion process, such as chromizing. Alternatively, the metallic coating may be formed by depositing a distinct coating layer or layers onto the component substrate surface, forming what is referred to as a metallic overlay coating.

The metallic coatings may include dispersed phases, such as carbides, borides, oxides, and/or silicides, within the iron, nickel, and/or cobalt alloy matrix to enhance the performance of the coating. Examples of metallic wear-resistant coatings are chrome-carbide/nickel-chrome and tungsten carbide/cobalt coatings, which are used to provide wear and abrasion resistance at critical locations on gas turbine components such as fan blade mid-spans and turbine seal areas. A variety of metallic overlay coatings are disclosed in U.S. Pat. Nos. 4,588,606, 4,666,733, 4,803,045, 5,326,645, and 5,395,221, which patents are incorporated herein by reference.

One important class of metallic overlay coatings is known as an "MCrAlY" coating, in which M is Ni, Co, and/or Fe. These MCrAlY coatings are typically applied by physical vapor or thermal spray deposition and provide high temperature oxidation and/or corrosion resistance. Examples of MCrAlY coatings are disclosed in U.S. Pat. Nos. 3,993,454, 4,585,481, and European patents EP 0688885 and EP 0688886, each of which is incorporated herein by reference.

Metallic overlay coatings may be used as an intermediate layer to bond a subsequent ceramic coating to a metallic substrate. Examples of overlay coatings used as bondcoats are disclosed in U.S. Pat. Nos. 5,520,516, 5,536,022, 4,861,618, 5,384,200, 5,305,726, 5,413,871, and 5,498,484, each of which is incorporated herein by reference.

Metallic MCrAlY overlay coatings are commonly utilized for oxidation and corrosion protection of high temperature, high strength cobalt and nickel superalloy gas turbine engine components. These components are usually complex castings with intricate internal passages which provide cooling to the component and allow the component to operate in turbine environment where the gas temperature may exceed the melting temperature of the superalloy. The demands for more efficient cooling and lower weight results in strict dimensional specifications for component wall thickness and coating thickness and uniformity. For example, there are regions on small, intricate aircraft gas turbine airfoils where the actual thickness of the part may be as thin as 1–2 mm. For these components, the MCrAlY coating thickness specification may be on the order of 50–75 $\mu$m. Large industrial ground turbine (IGT) blades and vanes also are fabricated to provide internal cooling and also have strict dimensional tolerances on component wall thickness in order to satisfy component strength requirements. For these components the MCrAlY coating thickness requirements are typically on the order of 150–200 $\mu$m. The MCrAlY coatings provide oxidation and corrosion protection by formation of a protective aluminum oxide scale which forms at high temperature during service. The aluminum in the coatings, typically on the order of 6–18 percent, provides a reservoir for aluminum oxide scale reformation as degradation occurs due to thermal cycling, erosion, corrosion, etc. Because the temperature, erosion activity, and deposition of foreign contaminants varies from area to area, degradation often occurs locally, resulting in significant differences in coating thickness and chemistry over the surface of a part with continued service exposure. The coating chemistry can also change due to diffusion between the coating and the substrate. The interdiffusion between coating and substrate is also a function of temperature and so compositional changes due to interdiffusion will also vary from region to region a part.

As the strength and lifetime requirements for industrial components, especially those exposed to high operational temperatures, have increased, processing complexity and the cost of these components has greatly increased. It is, therefore, important that the components protected by these coatings be re-used, that is, taken from service at regular intervals and processed where possible to restore materials dimensions and properties and be returned into service. This processing usually requires the removal of the overlying protective coatings.

As was mentioned, a major obstacle in the removal of these coatings is that the coatings are often degraded, and have local variations in thickness, due to accelerated local wear, oxidation, corrosion, or erosion. Thus, a part which had a coating with an applied thickness varying between 150 and 200 $\mu$m may be returned for repair with some regions having coating thicknesses of less than 50 $\mu$m whereas other regions have virtually the original coating thickness of 200 $\mu$m. Additionally, the coating chemistry may also vary across the surface of a part due to local variations in exposure to temperatures and contaminants. These local variations in thickness and chemistry complicate coating removal by affecting local coating removal rates. In addition, while removing the coatings, it is imperative that damage to the underlying substrate material, or removal of substrate material itself, be minimized. Attack or removal of the substrate below the degraded coating can cause component loss due to thinning of the component wall.

One present method for removal of metallic overlay coatings is by utilizing strip solutions of nitric or hydrochloric acid which attack the aluminum-rich phases in the coating. However, these acid strip solutions are ineffective for removing metallic overlay coatings in which the aluminum content has been reduced by diffusion and dilution into the base material and by repeated thermal cycling. Moreover, because the loss of aluminum from the coating frequently varies in severity over the surface of the coating, acid stripping can cause non-uniform stripping rates and possibly attack of the base material substrate itself. Attack of the substrate can result in component loss due to local thinning or degradation of the component wall thickness which ultimately renders the component unusable due to insufficient wall thickness.

Metallic overlay coatings which cannot be successfully stripped with acid solutions are often removed by manual mechanical means, such as by grinding, belt sanding or intense blasting with abrasive media and/or water at high pressure. These mechanical means are difficult to control and may cause loss of the dimensional integrity of the substrate component.

Several recent methods to prepare coated turbine blades for stripping include aluminizing the blades by pack cementation prior to stripping to make the coating easier to remove by chemical and/or mechanical means. In an article entitled "Refurbishment Procedures for Stationary Gas Turbine Blades", Proceedings of an International Conference jointly sponsored by ASM International and The Electric Power Research Institute, Phoenix, Ariz. (April 17–19, 1990), edited by Viswanathan and Allen, Burgel et al. disclose what they refer to as "one negative example" of what can occur during stripping using this approach. Burgel et al. disclose that, because pack cementation requires high temperatures which lead to inward diffusion of elements of the residual coating into the microstructure of the turbine blade, the aluminizing procedure results in deterioration of the whole wall thickness at the leading edge of the blade.

Czech and Kempster, PCT Application WO 93/03201 (1993), disclose a pack cementation aluminizing procedure which purportedly overcomes the problems associated with aluminizing disclosed by Burgel et al. by ensuring that all corrosion products in the coating and substrate are completely enclosed within the deposited aluminide coating. In the procedure of Czech, the surface of a superalloy or steel part is first cleaned, by chemical or physical means, to remove a substantial part of corrosion products on the surface. The cleaned part is then aluminized in an inert atmosphere by either pack aluminizing, out of pack aluminizing, or gas phase aluminizing to a depth that encloses all products of corrosion, including deep corrosion products, thus preventing the inward diffusion of deleterious phases, such as sulfides, within the substrate. In order to achieve a depth of aluminization that encloses all products of corrosion, high processing temperatures of at least 1050° C. must be used. The procedure of Czech results in an aluminide layer of uniform thickness greater than 150 μm over the surface of the substrate.

The procedure of Czech has several disadvantages which add process complexity or limit its applicability. Because all corrosion products, including "grain boundary sulfides", must be encompassed during the aluminization process, which requires a depth of aluminization of greater than 150 μm, temperatures of 1050° C. or higher must be employed, either in an initial treatment if a low activity pack is used or as a subsequent treatment if a high activity pack is used initially. These high temperatures can cause damage to delicate metal parts, such as turbine blades. These high temperatures also can complicate the removal of the aluminide layer in many applications. Processing aluminide layers in temperature ranges above 1050° C. on carbon-containing cast nickel and cobalt superalloy materials produces a zone of carbide precipitates below a diffused aluminide surface layer. The mechanisms and reasons for the formation of this "carbide zone" are well established within the technical literature related to formation of aluminide layers on gas turbine alloy materials (see by reference, "Formation and Degradation of Aluminide Coatings on Nickel-Base Superalloys, Goward et al. Transactions of the ASM, Vol. 60, 1967, pages 228–241). Formation of this zone of carbide precipitates during aluminization complicates removal of the aluminide layer, because the zone containing these carbide precipitates is difficult to remove by mechanical means and typically requires a combination of chemical and mechanical methods to completely remove it and expose superalloy base metal surface. Czech reports that he prefers a combination of mechanical and chemical methods for removing the aluminide layer.

Also, the method of Czech, utilizing pack cementation, results in the surface of the part receiving the entire depth of the aluminizing treatment unless the surface of the part is masked to completely block the formation of any aluminide layer at all in the masked area. Thus, the method of Czech does not permit controlled formation of aluminide layers of varying depths at different regions of the surface of a part, such non-uniform aluminide layers being desirable when a coating to be removed has a non-uniform thickness or when corrosion depth varies locally within a metallic surface layer.

Further, because of the necessity of forming an aluminide layer which encloses all corrosion products to a depth of 150 μm, the method of Czech precludes a partial strip process of a coating which has corrosion, wear, or oxidation damage confined to a relatively thin outer surface layer of the coating, with the bulk of the underlying coating being suitable for re-use or re-coating. For example, as disclosed by Czech, a part having a 100 μm thick coating with corrosion limited to the outer 50 μm of the surface would have the entire coating and a portion of the underlying substrate material aluminized and removed.

An additional disadvantage of the method of Czech is that, because of the nature of the pack cementation process, an inert atmosphere must be used to protect aluminum and other components in the pack from high-temperature attack by atmospheric oxygen.

Guerreschi EP 0713957 A1 discloses a method for localized aluminization of an MCrAlY coated turbine blade which method comprises cleaning the blade by sand blasting, masking off with tape those areas which are to be left unaluminized, applying a layer of aluminum by plasma spray, and heating the blade to the solution heat treat temperature of the blade substrate, which temperatures are generally above 1100° C., in a furnace and in an inert atmosphere. The treatment of Guerreschi causes the aluminum to diffuse into the coating, which produces a brittle aluminide coating which can be subsequently removed by sand blasting.

The method of Guerreschi has the disadvantages that high temperature treatment is required, above the solution heat treat temperature of the metal substrate, which temperatures can lead to thermal damage of delicate metal parts, such as those in turbomachinery, and can cause the formation of undesirable carbide phases within a carbon-containing superalloy substrate. Furthermore, during subsequent heating, the plasma spray deposited aluminum layer tends to flow laterally due to surface tension and gravitational forces, with resultant undesired removal of base material from masked-off regions and unintended differences in depth of aluminization and surface layer removal. See FIGS. 1 and 2.

The method of the present invention overcomes the disadvantages of the prior art in providing a method for the removal of metallic coatings which method comprises low temperature application of an aluminide layer by slurry deposition on the metallic surface. The method of the invention obviates the need to encompass all products of corrosion, can be precisely varied in thickness across the surface to be treated, can be applied locally with precision, may be performed in a non-inert atmosphere, and does not result in undesirable phase transformations within the substrate.

SUMMARY OF THE INVENTION

In one embodiment, the invention is a method for removing a metallic surface layer from a coated part or object, which method comprises reacting the metallic surface layer with molten aluminum or aluminum alloy, which has preferably been deposited on the surface of the metal in the form of a slurry, to produce an aluminide layer comprising the surface layer, and then removing the aluminide layer. The aluminide layer thus formed is brittle, and may be readily removed by mechanical or chemical means. Because the aluminide layer incorporates the surface layer, therefore making the surface layer an integral part of the aluminide layer, the surface layer is removed along with the aluminide layer. The method may be repeated to remove additional surface layers of the metallic coating, if desired.

The method of the invention is suited for the removal of metallic coatings from the surface of parts, such as superalloy or steel rotating or non-rotating turbine components. Examples of metallic coatings which may be removed from a surface by the method of the invention include coatings in which the predominant constituent of the alloy matrix phase is formed from an alloy base of a transition metal, such as nickel, iron, cobalt, titanium, or niobium, which readily forms brittle aluminide intermetallic phases. One such metallic overlay coating is referred to as a MCrAlY coating, where M is Ni, Co, Fe, or a combination thereof.

The aluminum is applied to the surface of a metallic coating by means of a slurry containing aluminum particulate in an inorganic glassy or ceramic binder. After application of the slurry, the part is heated to a temperature at which the aluminum melts, which temperature is typically below 1050° C. The molten aluminum, constrained by the inorganic binder network, flows inward into the surface of the metallic coating and reacts to form a brittle aluminide intermetallic surface layer. The aluminide layer, comprising the surface layer, is removed by any suitable means, such as by chemical or physical means, or a combination thereof.

The method of the invention is especially well suited for the removal of degraded metallic overlay coatings of varying thicknesses along the surface without significant removal of substrate metal from below relatively thin areas of the coatings, as the depth of the aluminide layer can be controlled by varying the amount of slurry applied to different regions of the surface of the substrate. The method of the invention is also well suited for the localized removal of metallic surface layers, as areas where no removal is desired may be masked to prevent formation of the aluminide layer in these areas. The method of the invention is also well suited for producing a partially stripped part having some functional coating remaining following stripping of a degraded surface layer, as the process can be performed to aluminize and remove a surface layer between 25–100 $\mu$m in depth. Furthermore, the lower processing temperatures of the invention as compared to pack aluminization minimize or eliminate precipitation of problematic carbides below the aluminide layer which can hinder removal of the resultant aluminide layer. Consequently, the invention is particularly well suited for removal of non-uniform or thin metallic coating layers, when interaction with the substrate alloy is more likely to occur. The lower processing temperatures also decrease the likelihood of inward diffusion of deleterious phases within the superalloy substrate, as described by Burgel.

The process of the invention, utilizing relatively low processing temperatures, provides a significant advance in the removal of metallic coatings, such as from steel or superalloy gas turbine components, or of degraded metallic coatings from engine-run gas turbine components. As opposed to prior art methods which aluminize by pack cementation at high temperatures and which necessitate the encompassing of all products of corrosion by a single high-temperature aluminization step, the process of the invention minimizes or eliminates precipitation of carbides which can hinder removal of the resultant aluminide layer and decreases the likelihood of inward diffusion of deleterious phases within the superalloy substrate.

DETAILED DESCRIPTION OF THE INVENTION

Figure 1:
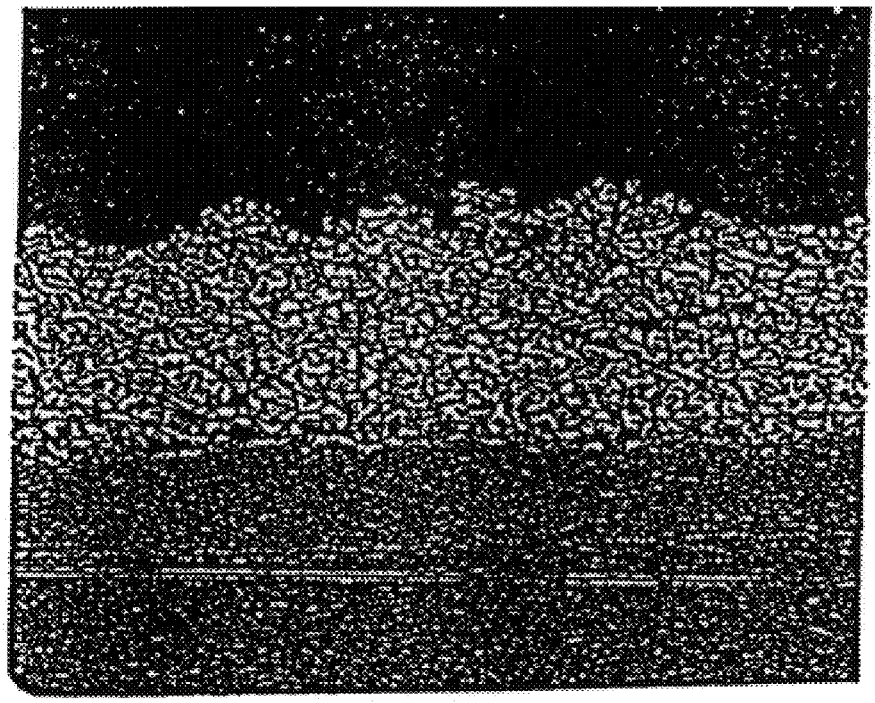
FIG. 1 shows a prior art aluminum layer deposited on a metallic surface by plasma spray.
Figure 2:
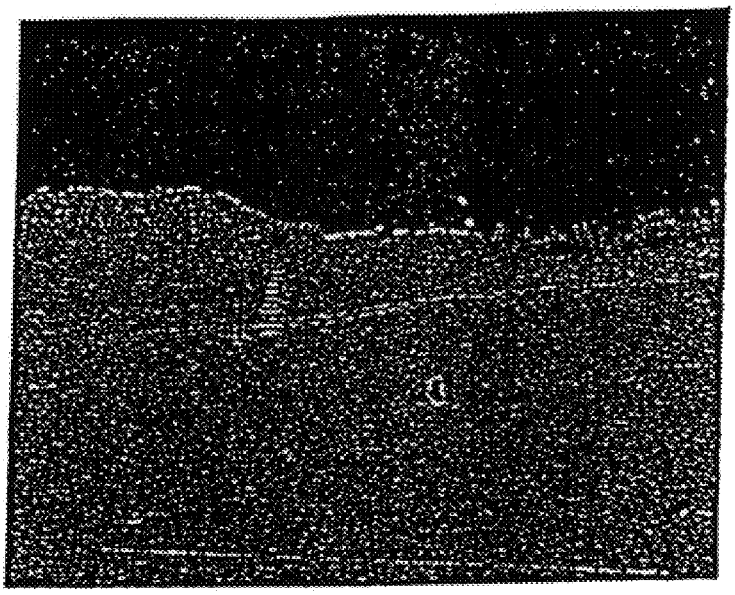
FIG. 2 shows a prior art aluminide coating formed from an aluminum layer deposited by plasma spray.

In accordance with the method of the invention, the surface layer of a metallic coating is removed by applying a slurry of aluminum in an inorganic binder to the surface of a part coated with the coating, heating the coated part to melt the aluminum which flows inward into the surface and reacts with the surface to form an aluminide layer which is brittle and can be removed by chemical or physical means.

The surface layer to be removed may be of any composition which reacts with molten aluminum to form a brittle aluminide intermetallic surface layer. In particular, this layer to be removed may be part of a protective metallic overlay coating which has been deposited on a part fabricated from a separate substrate alloy or material. Examples of coating layers which may be removed from the substrates include MCrAlY coating layers, wear-resistant carbide-containing cobalt-based coating layers, and metallic nickel-chrome coating layers.

Alternatively, the surface layer to be removed may be a portion of the surface of an iron, nickel, or cobalt alloy which has been modified by a diffusion process to form a coating layer. These "diffusion layers" may comprise additional elements such as chromium, silicon, boron, or phosphorus.

The substrate may be any material which can withstand the processing conditions according to the process of the invention, such as the aluminizing and removing of the coating surface layer. Examples of suitable substrates include nickel, cobalt, and ferrous superalloys, steel, and oxide or non-oxide ceramics.

Prior to application of the aluminum, the part is preferably cleaned to remove loose surface corrosion products and to degrease the surface. Suitable cleaning methods include physical methods, such as by grit blasting, and chemical methods, such as by aqueous acid pickling.

The aluminum in the slurry is in the form of aluminum metal pigments in a contiguous ceramic or glassy binder. The aluminum may be as elemental aluminum powder or as alloys of aluminum, such as silicon or magnesium alloys of aluminum. In addition to the aluminum, the slurry may comprise metallic elemental powders such as silicon and/or magnesium which facilitate melting and diffusion of the aluminum into the metallic surface.

The binder is of an inorganic material which provides adhesion of the aluminum-rich slurry to the metallic surface.

As the part is heated, the binder also promotes inward transport of molten aluminum and wicks the aluminum into the metallic surface, while preventing lateral flow of the molten pigments. The binder preferably should remain stable at temperatures at which the aluminum pigments melt and should not interfere with the surface aluminization reactions. Suitable binders include glasses such as chromate, phosphate, or silicate glasses, and ceramic oxides. Suitable slurries containing aluminum in an inorganic binder are disclosed in U.S. Pat. Nos. 3,248,251, 4,617,056, 4,724,172, which disclose slurries of metal pigments in an inorganic chromate-phosphate binder, and U.S. Pat. No. 5,478,413, which discloses slurries which are substantially free of chromate.

The aluminum-containing slurry is applied to the metallic surface of the part by any suitable method for applying slurries, such as by brushing, dipping, or spraying. Any method to apply the slurry is acceptable for the process of the invention, so long as the method of slurry application allows deposition of controlled slurry amounts without sagging, running, cracking, or separating of the slurry.

Figure 3:
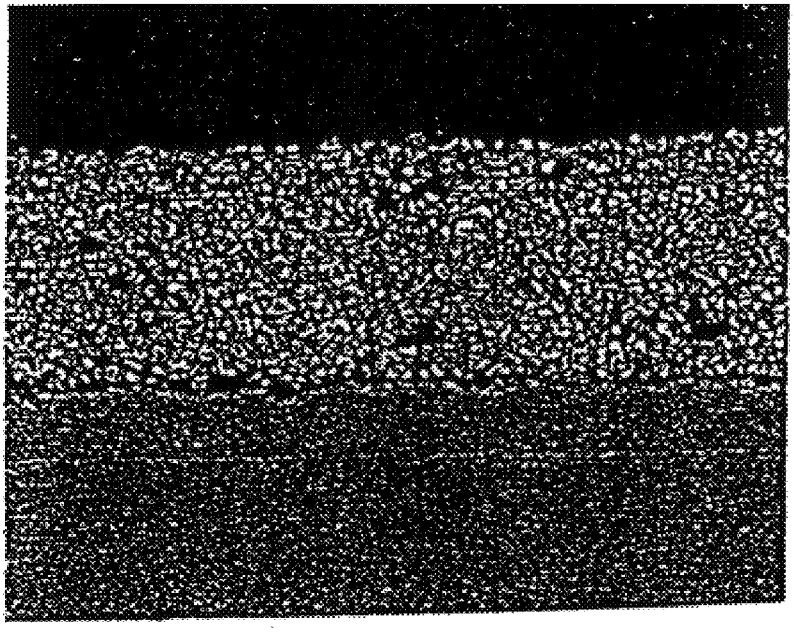
FIG. 3 shows an aluminum layer deposited on a metallic surface by means of a slurry, in accordance with the method of the invention.
Figure 4:
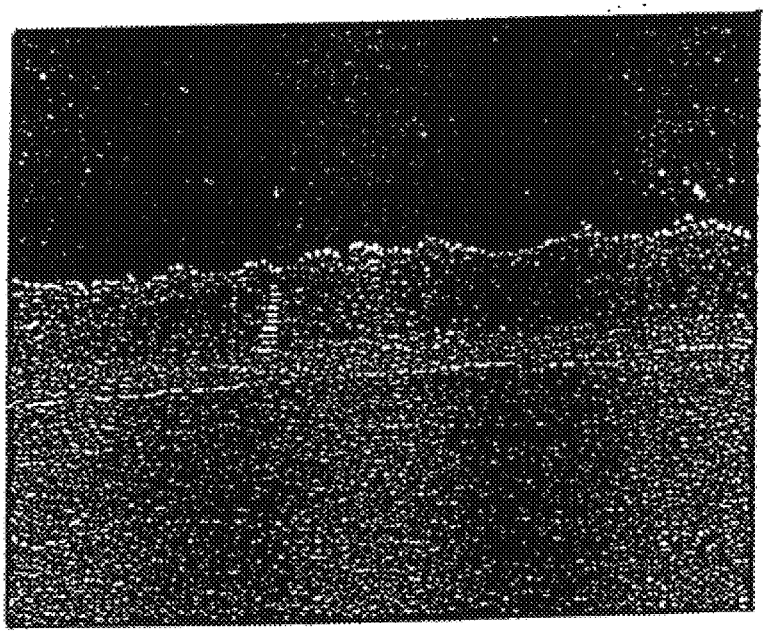
FIG. 4 shows an aluminide coating formed from an aluminum layer deposited on a metallic surface by means of a slurry, in accordance with the method of the invention.

If desired, portions of the part where the metallic surface is to be left undisturbed by application of the method of the invention may be masked by adhesive tape, metal foil, or fixtures fabricated from organic or inorganic molding materials before application of the slurry. The slurry may be applied to a uniform depth in all areas to be treated or may be applied in varying thicknesses, as desired, to produce a locally uniform aluminide layer of proportionally varying thicknesses over the surface of the part. See FIGS. 3 and 4. In this way, the thickness of the metallic layer which is to be removed from the surface can be controlled over different regions on a part, with different areas having different thicknesses of surface layer removed.

Following application of the slurry, the slurry is heated to a temperature sufficient to melt and diffuse the aluminum-rich pigments into the metallic surface layer to be removed. If desired, the slurry may be cured prior to melting and diffusion of the pigments, although this is generally not necessary. Depending on the composition of the binder, the slurry can be cured at temperatures between 20° C. and 500° C., preferably between 200° C. and 350° C. Curing of the binder, however, is generally not required.

Processing temperatures should be at or above the temperature required to melt the aluminum-rich pigments in the slurry and to form an aluminide surface layer, but below that at which undesirable phase formation, such as carbide phases, occurs within the base material. Temperatures between about 760° C. and 1080° C. are suitable, although processing temperatures below 760° C. may be effective, as long as the temperature used is sufficient to melt and diffuse the aluminum in the slurry into the metallic surface layer of the part. Temperatures above 1080° C. may also be used, if the possible resultant damage to the substrate may be tolerated, such as changes in the chemistry of the substrate or warping of the substrate. Processing temperatures between 885° C. and 1050° C. or below, such as at 1000° C. or below, are preferred.

The part coated with the aluminum slurry is exposed to the processing temperature for a time sufficient to allow the aluminum of the slurry deposit to melt and react with the metallic surface to form an aluminide layer. Generally the time required for melting and diffusion of the aluminum slurry to form the aluminide layer is between 0.5 hours to 20 hours, although typically 2 to 8 hours is sufficient.

In contrast with pack aluminization processes which require an inert atmosphere or a vacuum, the aluminization processing according to the method of the invention may be performed in an air atmosphere as well as in an inert gas atmosphere or in a vacuum. However, processing in an inert or vacuum atmosphere is preferred if the part to be treated contains uncoated areas where undesirable oxidation would occur if processing were performed in an air atmosphere.

The depth of the aluminide layer thus formed will vary, depending on the deposited amount of the aluminum slurry, processing temperature, and processing time, and composition of the metallic surface layer, from a depth of only a few microns, such as 10 microns, up to about 200 $\mu$m, such as 125 to 150 $\mu$m, or any depth in between. The aluminide layer will be of uniform thickness in areas which are subjected to identical treatment. See FIG. 4.

That is, the layer will be locally uniform, but may vary from spot to spot on the surface due to differing depths of local aluminum slurry deposited. Local variations in coating composition may also affect surface layer aluminization and subsequent depth of removal.

Following production of the surface aluminide layer, the brittle aluminized surface is removed by a mechanical and/or chemical process. Prior to removal, the treated part may or may not be allowed to cool. Suitable mechanical means for removing the aluminized surface include abrasive grit blasting, such as with ceramic oxide powder, grinding, and belt sanding.

Removal of the aluminide layer results in removal of the surface of the metal to the depth to which the aluminide layer had formed within the surface. The surface may then be recoated, such as with a MCrAlY coating, or may be left uncoated. Alternatively, if further removal of surface layers is desired, the process of the invention may be repeated without deleterious effect to the substrate.

Figure 5A:
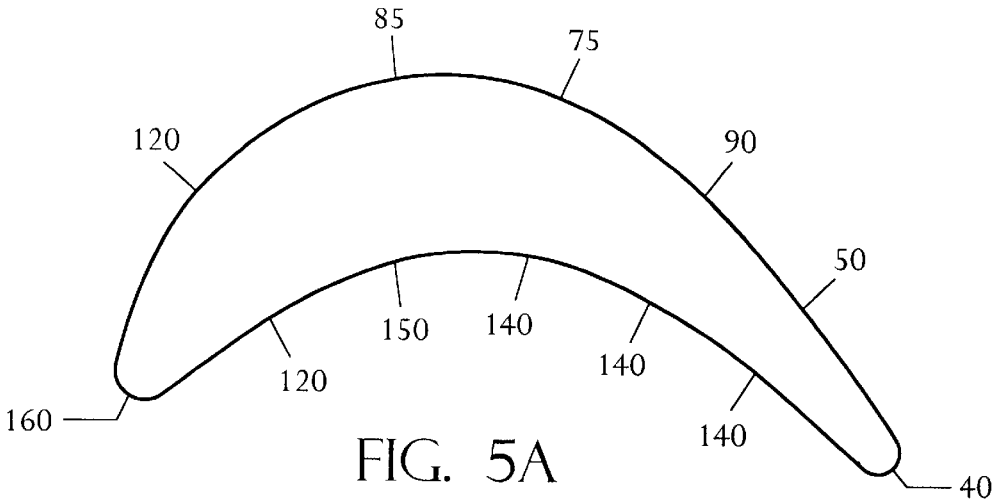
FIGS. 5*a,* 5*b* and 5*c* diagrammatically show distributions of metallic MCrAlY coating thicknesses in microns along the surface of an engine-run turbine blade before and after stripping in accordance with the method of the invention.
Figure 5B:
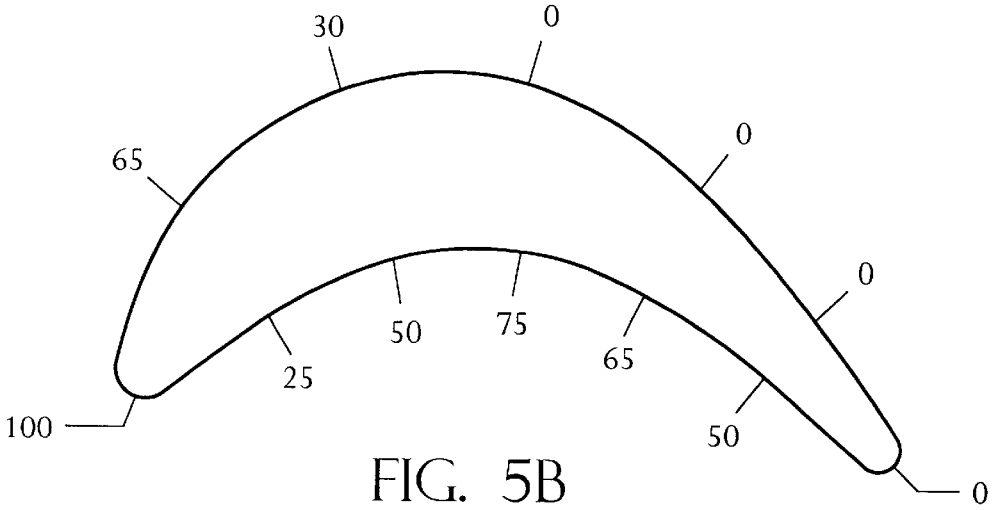
Figure 5C:
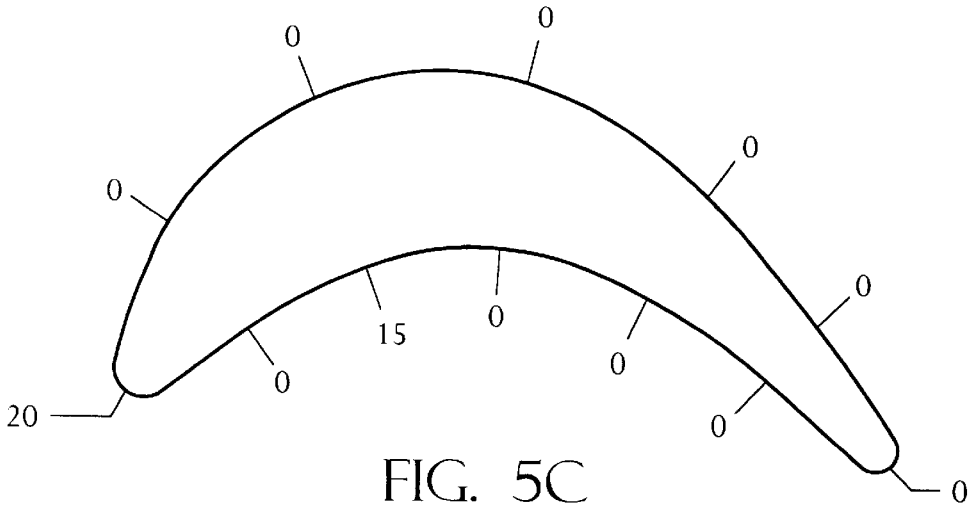

FIGS. 5*a* to 5*c* show metallic CoCrAlY coating thickness distributions in microns around an engine-run turbine blade. FIG. 5*a* shows the initial coating thickness distribution prior to stripping. FIG. 5*b* shows the coating distribution after one strip cycle using a generally uniform aluminum-filled slurry application of 50–75 mg/cm$^2$ around the entire airfoil surface. The coating thickness distribution in FIG. 5*b* shows that a generally uniform surface layer of approximately 75–100 $\mu$m thick was removed by this process.

FIG. 5*c* shows the turbine blade of 5*b* following an additional strip cycle in which a non-uniform thickness slurry was applied to the part surface to adjust the stripping rate for local variations in the remaining coating thickness in order to minimize base metal removal. In regions of the concave surface of the turbine blade having less than 50 $\mu$m of coating remaining after the first strip cycle, a slurry deposit of 15–20 mg/cm$^2$ was applied. In regions having between 50–75 $\mu$m of remaining coating, a slurry deposit of about 25–35 mg/cm$^2$ was applied. No slurry was deposited on locations which were already stripped. As shown in FIG. 5*c*, the variation in slurry deposit effectively stripped the MCrAlY coating from the concave surface of the blade with minimal amount of base metal removal.

Experience with the method of the present invention has shown that the surface layer removal rate of the stripping process varies depending on several factors. One such factor is the chemistry of the metallic surface layer to be removed, which may vary locally on the surface of a part as well as through the thickness of the coating layer. Generally, engine-run coating layers which are depleted in aluminum due to exposure to high temperature, thermal cycling, and/or interactions with the base metal substrate tend to strip at a relative faster rate than coating layers with relatively higher aluminum content. The process conditions, such as time, temperature, and diffusion atmosphere, as well as the amount of slurry deposit also affect the stripping rate, with higher processing temperatures, longer times, and greater amount of slurry deposit generally causing increases in stripping rate. Because the stripping process is based upon the conversion of the metallic coating surface layer to a brittle intermetallic aluminide layer, the stripping rate is directly related to the ability of the molten aluminum from the slurry deposit to react with and to penetrate the metallic coating to the required depth. In general, depth of penetration of the aluminization process is between 40% to 90% of the total aluminide layer thickness formed by the method, the depth of penetration being related to the abovementioned factors. Examples 3 to 6 illustrate processes which resulted in a metallic surface layer penetration depth of 60–856 of the total aluminide layer thickness.

The following non-limiting examples are illustrative of the invention.

EXAMPLE 1

A gas turbine airfoil of a cast nickel-base superalloy coated with a NiCrAlY coating varying in thickness from 50 μm to 300 μm was prepared for stripping of the coating by cleaning by grit blasting. Following cleaning, approximately 30 mg/cm$^2$ of an aluminum metal powder slurry in an aqueous acidic binder of chromate and phosphate solids, as disclosed in Example 7 of U.S. Pat. No. 4,724,172, was applied to the surface of the airfoil. The airfoil was then heated at a temperature of 350° C. for 30 min. to form a cured glassy binder network. Next, the airfoil was heated to 885° C. in a hydrogen gas environment and held at that temperature for 2 hours. The part was allowed to cool and was grit blasted at 60 psi with 90 grit aluminum oxide powder. Metallographic examination revealed that a uniform surface layer, approximately 65 μm thick, was removed from the airfoil. In regions of the airfoil where the coating was less than 65 μm thick, the aluminized layer of substrate metal was also completely removed with no trace of residual aluminide or carbide zone.

EXAMPLE 2

The airfoil section from Example 1 was processed through a second stripping cycle by applying a uniform layer of aluminum slurry of approximately 25 mg/cm$^2$ to the entire airfoil surface and curing the slurry deposit at 350° C. for one hour in a convection oven. The region of the airfoil which was bare of coating after the first strip cycle of Example 1 was then masked with tape and an additional 20 mg/cm$^2$ approximately of slurry was applied to the rest of the airfoil to demonstrate the ability of the process to selectively remove heavier metallic coating layers. The part, after curing, was then given a diffusion cycle as in Example 1 and grit blasted. The region of the nickel-base superalloy which was bare of coating after Example 1 was completely free of any aluminide surface conversion layer and "carbide zone" after the mechanical coating removal process. Approximately 90–125 μm of NiCrAlY coating was removed from the regions receiving the heavier application of slurry.

EXAMPLE 3

A section of a nickel-superalloy base industrial gas turbine blade having a 150 μm thick degraded CoNiCrAlY metallic coating was grit blasted at 60 psi with 90–120 grit aluminum oxide. About 40 to 50 mg/cm$^2$ of the slurry of Example 1 was deposited onto the CoNiCrAlY surface, and the slurry was heated at 350° C. to cure the slurry binder. The blade section was then heated to 1050° C. in an inert argon gas environment and held at that temperature for 2 hours. The part was allowed to cool. Metallographic evaluation of the part showed that an aluminide layer 175 μm thick had formed. The surface of the part was then grit blasted using 90–120 grit at 60 psi. Metallographic evaluation of the grit blasted surface showed complete removal of the aluminide layer, leaving the part surface free of remnant metallic coating.

EXAMPLE 4

A section of a nickel-base superalloy industrial gas turbine blade having a 100 μm thick degraded CoNiCrAlY metallic coating was grit blasted at 60 psi with 90–120 grit aluminum oxide to prepare the surface prior to application of about 40–50 mg/cm$^2$ of the slurry of Examples 1 and 3. The applied slurry was cured at 350° C. The blade section was then heated to 760° C. in an air environment and held at that temperature for 2 hours. The part was allowed to cool. Metallographic evaluation of the part showed that an aluminide layer 150 μm thick was formed. The surface of the part was then grit blasted using 90–120 grit at 60 psi, which resulted in the complete removal of the aluminide layer, leaving the part surface free of remnant metallic coating, as determined by metallographic evaluation.

EXAMPLE 5

A section of a nickel-base superalloy industrial gas turbine blade having a degraded CoNiCrAlY metallic coating as in Example 3 was grit blasted at 60 psi with 90–120 grit aluminum oxide to prepare the surface for the deposition of a slurry of aluminum and silicon metal powders dispersed in an aqueous acidic chromate/phosphate binder. The silicon metal powder was approximately 12% of the total metal powder pigment by weight proportion, the slurry known commercially as SERMALOY J™ (Sermatech International, Limerick Pa.). Approximately 30–40 mg/cm$^2$ of the slurry was deposited onto the CoNiCrAlY surface, and the slurry was heated at 350° C. in an industrial oven to cure the slurry binder. The blade section was then heated to 1050° C. in an inert argon gas environment an held at that temperature for 2 hours. The part was allowed to cool. Metallographic evaluation of the blade showed that an aluminide layer 100 μm thick was formed. The surface of the part was then grit blasted using 90–120 grit at 60 psi. Metallographic evaluation of the grit blasted surface showed complete removal of the aluminide layer. About 75 μm of metallic coating was removed from the surface.

EXAMPLE 6

A section of an industrial gas turbine blade having a degraded CoNiCrAlY metallic coating as in Example 3 was grit blasted at 60 psi with 90–120 grit aluminum oxide to prepare the surface for the deposition of the slurry of Example 5. About 30–40 mg/cm$^2$ of the slurry was deposited onto the CoCrAlY surface, and the slurry was cured at 350° C. in an industrial oven to cure the slurry binder. The blade section was then heated to 760° C. in an air environment and held at that temperature for 2 hours. The part was allowed to cool. Metallographic evaluation revealed that an aluminide layer 75 μm thick was formed. The surface of the part was then grit blasted using 90–120 grit at 60 psi. Metallographic evaluation of the grit blasted surface showed complete removal of the aluminide layer and removal of approximately 50 μm of metallic coating from the surface.

EXAMPLE 7

A nickel superalloy test sample coated with approx. 250 μm of a chrome carbide-nickel chrome wear coating comprised of dispersed wear resistant chrome carbide particles in a nickel-chromium metallic matrix was grit blasted at 40 psi with 90–120 grit aluminum oxide to prepare the surface for the deposition of the slurry of Example 5. Approximately 10–15 mg/cm$^2$ of the slurry was deposited onto the coating surface, and the slurry was heated at 350° C. in an industrial oven to cure the slurry binder. The test sample was then heated to 885° C. in a vacuum environment and held at that temperature for 2 hours. The part was allowed to cool. Metallographic evaluation of the part showed that a continuous aluminide layer 35 μm thick was formed on the nickel-chromium wear coating similar to that formed on the metallic coatings in the previous Examples, which aluminide layer may be removed by grit blasting or other suitable means.

Example 8

A layer of aluminum metal 150–200 μm thick was deposited by plasma spray onto one side of a nickel-base superalloy test specimen coated with a 100 μm thick NiCoCrAlY coating following an initial 120 grit blasting surface cleaning operation. A 250 μm thick layer of the aluminum-filled slurry of Example 3 was applied to the other side of the test specimen. The test specimen was heated to 1050° C. under a protective argon atmosphere. Upon cooling of the sample, metallographic evaluation of the aluminized surfaces revealed local non-uniform diffusion of aluminum by the plasma spray, with some portions showing aluminizing completely through the MCrAlY coating layer and continuing with significant aluminization 75–100 μm within the base metal. Other portions showed marginal aluminization to a depth of less than 25 μm.

In marked contrast, the side of the test coupon coated with the aluminum slurry in accordance with the invention had developed a uniform, continuous aluminide layer 75 μm thick.

EXAMPLE 9

A section of industrial gas turbine blade of a nickel-base superalloy having new CoNiCrAlY coating layer of about 125 μm thickness was grit blasted at 60 psi with 90–120 grit aluminum oxide to prepare the surface for the deposition of a slurry of aluminum metal powders dispersed in an aqueous acidic chromate/phosphate binder, as described in Example 5. Approximately 40–50 mg/cm$^2$ of the slurry was deposited onto the MCrAlY surface, and the part was heated at 350° C. to cure the slurry binder. The blade section was then heated to 1080° C. in a vacuum environment and held at that temperature for 4 hours. The part was allowed to cool. Metallographic evaluation of the part showed that an aluminide layer 100 μm thick was formed similar in structure to that of Example 3, which layer was ready for removal as in Examples 1 through 6.

EXAMPLE 10

A dispersion of aluminum pigments was used to create a slurry similar to that in Example 3 except that a chrome-free aqueous binder composition, as those described in U.S. Pat. No. 5,478,413 was used in place of the chromate-containing binder of Example 3. Approximately 30–40 mg/cm$^2$ of the slurry was deposited onto a grit-blasted MCrAlY coated part, and the part was heated at 350° C. to cure the slurry binder. The coated part was then heated to 1080° C. in a vacuum environment an held at that temperature for 4 hours. The part was then cooled. Metallographic evaluation of this part showed that an aluminide layer 75 μm thick was formed similar in structure to that of Example 3, which aluminide layer was available for removal as in Examples 1 to 6.

EXAMPLE 11

A dispersion of aluminum pigments is used to create a slurry similar to that in Example 3 except that an aqueous binder of water-soluble potassium and sodium silicates is used in place of the chromate-containing binder. Approximately 25–30 mg/cm$^2$ of the slurry is deposited onto a grit-blasted 200 μm thick NiCoCrAlY metallic overlay coating which had been plasma sprayed onto a nickel-base superalloy panel which is then heated at 75° C. to cured the slurry binder. The panel is then heated to 885° C. in an argon gas environment and held at that temperature for 2 hours. The part is allowed to cool. Metallographic evaluation of the panel shows that an aluminide layer 75 μm thick is formed. The aluminized surface layer is able to be completely removed by grit blasting the surface.

EXAMPLE 12

A metallic turbine blade cast from a nickel-base superalloy and coated with a metallic CoCrAlY coating having a non uniform coating thickness distribution as shown in FIG. 5*a* was cleaned by grit blasting at 60 psi with 90–120 grit aluminum oxide. A slurry of aluminum metal powders dispersed in an aqueous acidic chromate/phosphate binder, as described in Example 5, was deposited by brushing onto the surface of the blade to an applied amount of about 50–75 mg/cm$^2$ using several coat/cure cycles to achieve the desired slurry deposit amount. The cure cycles were at 350° C. for about 45 minutes. Following the final slurry deposition, the part was placed in a retort furnace and diffused at 1050° C. for 4 hours in an argon atmosphere. Following the diffusion cycle, the part was removed from the furnace, allowed to cool, and was grit blasted at 90 psi with 90–120 grit aluminum oxide. Metallographic evaluation revealed the coating distribution shown in FIG. 5*b* with no trace of the aluminized surface layer.

Additional slurry was then applied by brush in varying amounts depending on the remaining metallic coating to be removed from the part, with areas having less than about 50 μm receiving slurry deposits of about 15–20 mg/cm$^2$ and areas having more than about 50 μm thickness of coating remaining receiving slurry deposits between 25–30 mg/cm$^2$. Areas of the blade which were identified as having been completely stripped by the first stripping procedure received no additional slurry deposit. The diffusion and grit blast operations were repeated. FIG. 5*c* shows the final coating thickness distribution, with the part being completely bare of the metallic overlay coating as well as of the diffused aluminized layer, except for minor vestiges of MCrAlY coating, as shown.

As will be apparent to those skilled in the art, in light of the foregoing description, many modifications, alterations, and substitutions are possible in the practice of the invention without departing from the spirit or scope thereof. It is intended that such modifications, alterations, and substitutions be included in the scope of the claims.

What is claimed is:

1. A method for removing a surface layer of metallic coating from a surface of a part comprising the steps of: applying to the metallic coating a slurry comprising aluminum or aluminum alloy in a binder, melting and diffusing the aluminum from the slurry into the metallic coating at a temperature below about 1050° C. and below the solution heat treat temperature of the part, thereby forming a diffusion coating of a brittle intermetallic aluminide layer which incorporates the surface layer of the metallic coating, and removing the brittle aluminide layer with the surface layer of the metallic coating.

2. The method of claim 1 wherein the surface layer of the metallic coating which is of a finite thickness comprises the entire thickness of the metallic coating.

3. The method of claim 1 wherein the metallic coating is a metallic overlay coating.

4. The method of claim 3 wherein the overlay coating is a MCrAlY coating wherein M is one or more metals selected from the group consisting of nickel, cobalt, and iron.

5. The method of claim 1 wherein the metallic coating is a metallic diffusion coating.

6. The method of claim 1 wherein the metallic coating comprises metals which form intermetallic compounds with aluminum.

7. The method of claim 1 wherein the metallic coating has an alloy matrix with a predominant constituent of one or more metals selected from the group consisting of iron, niobium, and titanium.

8. The method of claim 1 wherein the surface layer which is removed comprises corrosion products of the part.

9. The method of claim 1 wherein the melting and diffusion is caused by heating at a temperature between 760° C. and 1050° C. for about 0.5 to 20 hours.

10. The method of claim 9 wherein the heating is at a temperature between 885° and 1000° C.

11. The method of claim 10 in which the precipitation of carbides below the aluminide layer is minimized.

12. The method of claim 1 wherein, prior to heating the aluminum to melt and diffuse the aluminum into the surface layer, the slurry is cured.

13. The method of claim 1 wherein the melting and diffusion are performed in an air atmosphere.

14. The method of claim 1 wherein selected areas of the surface of the object are masked off prior to application of the slurry and the aluminide layer is not formed in the masked off areas.

15. The method of claim 1 wherein the thickness of the slurry is applied non-uniformly on the surface of the metallic coating.

16. The method of claim 1 wherein the thickness of the aluminide layer is 150 microns or less.

17. The method of claim 16 wherein the thickness of the aluminide layer is between about 75 and 150 microns.

18. The method of claim 1 wherein the part is a metal object.

19. The method of claim 18 wherein the metal part is a rotating or non-rotating component of a gas turbine engine.

20. The method of claim 1 wherein the slurry comprises, in addition to aluminum, a metal selected from the group consisting of silicon and magnesium.

21. The method of claim 1 wherein the slurry comprises, in addition to aluminum, a binder containing an inorganic material selected from the group consisting of chromate, phosphate, silicate, and ceramic oxide.

22. The method of claim 1 wherein the slurry is substantially free of chromate.

23. The method of claim 1 wherein the metallic coating has an alloy matrix with a predominant constituent of at least one metal selected from the group consisting of nickel and cobalt.

24. The method of claim 23 wherein the melting and diffusing of the aluminum from the slurry into the metallic coating is preformed below about 1000° C.

25. The method of claim 24 wherein the temperature is below about 1000° C.

26. The method of claim 24 wherein after the application of the slurry, the slurry is heated to a temperature sufficient to form a cured glassy binder but below the temperature for melting and diffusing the aluminum into the metallic coatings, and thereafter heating the cured slurry to a temperature for melting the aluminum and to a temperature below 1050° C., thereby diffusing the aluminum into the metallic coating.

27. The method of claim 26 wherein the curing temperature is not above 500° C.

28. The method of claim 24 wherein the part is a metal part.

29. The method of claim 1 wherein the part to be coated is a clean part.

* * * * *